US006916158B2

(12) United States Patent
Bishop

(10) Patent No.: US 6,916,158 B2
(45) Date of Patent: Jul. 12, 2005

(54) RADIAL PISTON PUMP

(75) Inventor: Michael B. Bishop, Sun Prairie, WI (US)

(73) Assignee: Actuant Corporation, Milwaukee, WI (US)

( * ) Notice: Subject to any disclaimer, the term of this patent is extended or adjusted under 35 U.S.C. 154(b) by 180 days.

(21) Appl. No.: 10/427,140

(22) Filed: Apr. 30, 2003

(65) Prior Publication Data

US 2004/0219032 A1 Nov. 4, 2004

(51) Int. Cl.[7] ..... F04B 1/26

(52) U.S. Cl. ..... 417/270; 417/206; 417/252; 417/273

(58) Field of Search ..... 417/205, 206, 417/252, 270, 273, 307

(56) References Cited

U.S. PATENT DOCUMENTS

| | | | | | |
|---|---|---|---|---|---|
| 2,642,804 | A | * | 6/1953 | Bowers | 417/252 |
| 3,657,971 | A | | 4/1972 | Freeman | |
| 3,667,868 | A | * | 6/1972 | Brunner | 417/273 |
| 3,756,749 | A | | 9/1973 | Aldinger | |
| 3,788,779 | A | | 1/1974 | Carlson | |
| 3,912,419 | A | * | 10/1975 | Lutz et al. | 417/252 |
| 4,048,907 | A | | 9/1977 | Engel | |
| 4,405,288 | A | | 9/1983 | Stockton | |
| 4,496,290 | A | | 1/1985 | Nonnenmacher | |
| 4,564,341 | A | | 1/1986 | Tanaka | |
| 4,601,641 | A | | 7/1986 | Kuroyanagi et al. | |
| 4,634,349 | A | | 1/1987 | Abe et al. | |
| 4,975,025 | A | | 12/1990 | Yamamura et al. | |
| 5,183,392 | A | | 2/1993 | Hansen | |
| 5,228,290 | A | | 7/1993 | Speggiorin | |
| 5,249,512 | A | | 10/1993 | Christenson | |
| 5,503,535 | A | | 4/1996 | Thoma et al. | |
| 5,509,347 | A | | 4/1996 | de Jong et al | |
| 5,538,400 | A | | 7/1996 | Konishi et al. . | |
| 5,542,823 | A | | 8/1996 | de Jong et al. | |
| 5,634,777 | A | | 6/1997 | Albertin et al. | |
| 5,647,729 | A | | 7/1997 | de Jong et al. | |
| 5,651,301 | A | | 7/1997 | Thoma et al. | |
| 5,752,427 | A | | 5/1998 | Leutner | |
| 5,848,565 | A | | 12/1998 | Thoma | |
| 5,865,087 | A | | 2/1999 | Olson | |
| 5,878,648 | A | | 3/1999 | Dworak | |
| 5,980,215 | A | | 11/1999 | Robeller et al. | |
| 6,030,185 | A | * | 2/2000 | Feigel et al. | 417/273 |
| 6,042,343 | A | | 3/2000 | Semba et al. | |
| 6,280,150 | B1 | | 8/2001 | Miyazawa | |
| 2001/0048880 | A1 | | 12/2001 | Hermann et al. | |
| 2002/0192092 | A1 | | 12/2002 | Mori | |

FOREIGN PATENT DOCUMENTS

| | | |
|---|---|---|
| EP | 1 013 921 A2 | 6/2000 |

* cited by examiner

*Primary Examiner*—Michael Koczo
(74) *Attorney, Agent, or Firm*—Quarles & Brady LLP

(57) ABSTRACT

A piston pump including an inlet manifold, and outlet manifold, and a piston ring sandwiched between the inlet and outlet manifolds. The inlet manifold has a first face and a second face with at least one outlet formed in the second face. The outlet manifold has a first face and a second face, and includes at least one inlet formed in the outlet manifold first face. The piston ring has an inlet face and an exhaust face, wherein the piston ring is sandwiched between said inlet manifold second face and said outlet manifold first face, and has at least one radially extending cylinder formed therein. The piston ring further includes an inlet passageway formed in the piston ring between the inlet face and the cylinder and in fluid communication with the inlet manifold. The piston ring also has an exhaust passageway formed therein between said cylinder and the exhaust face and in fluid communication with the outlet manifold inlet. A piston is disposed in the cylinder for reciprocating movement, wherein reciprocating movement of the piston allows fluid into the cylinder through the inlet passageway and exhausts fluid out of the cylinder through the exhaust passageway.

31 Claims, 11 Drawing Sheets

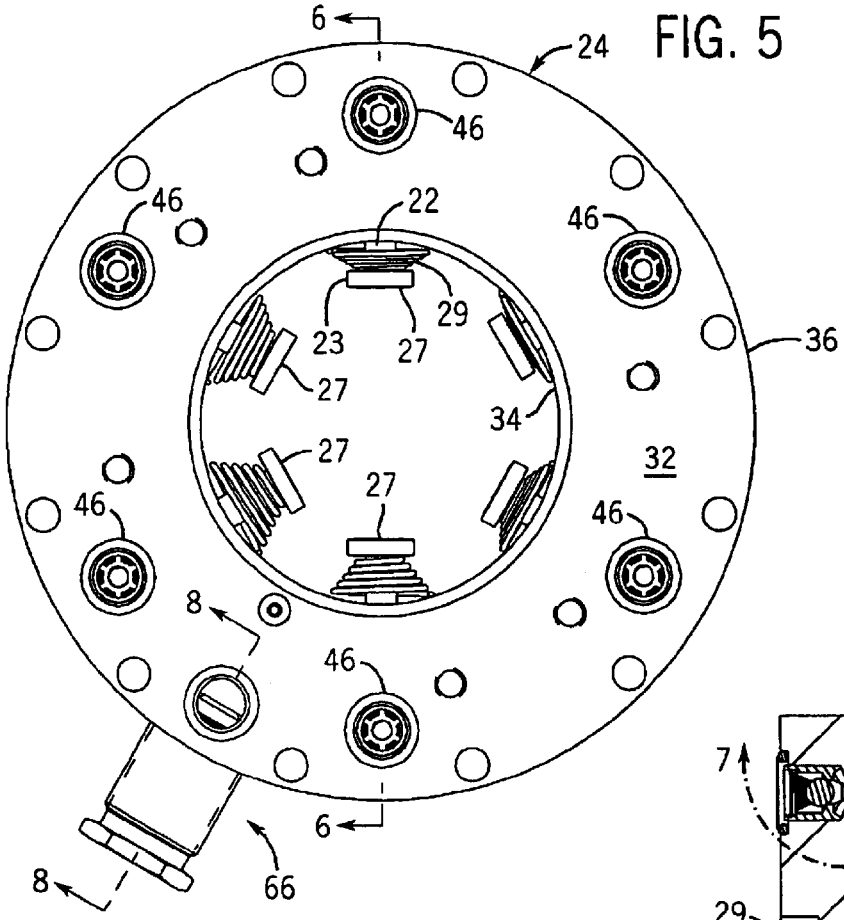
FIG. 5
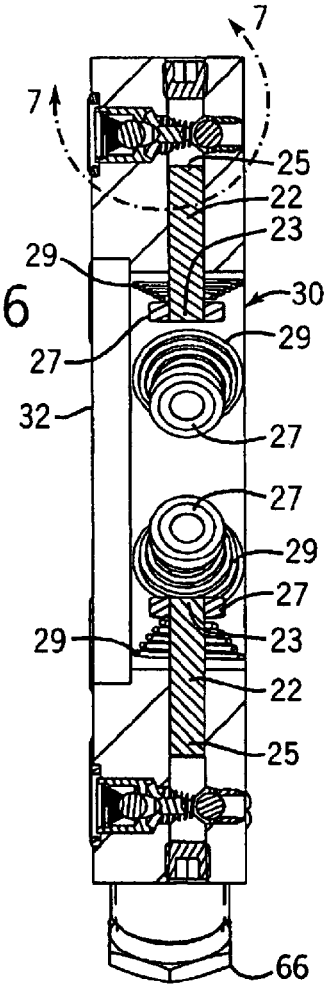
FIG. 6
FIG. 7
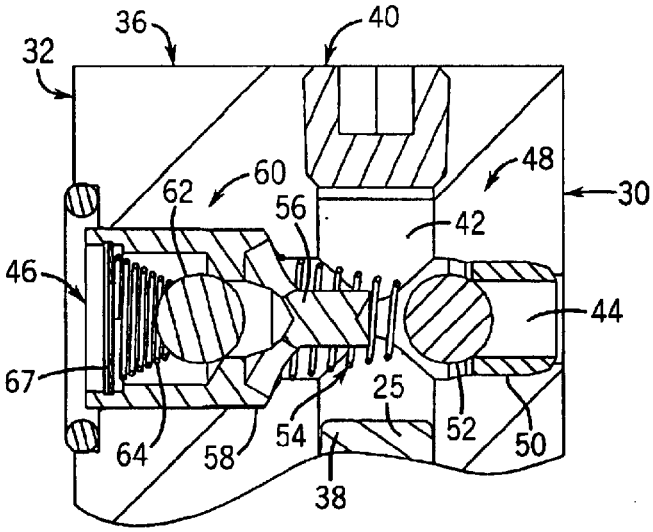

RADIAL PISTON PUMP

CROSS REFERENCES TO RELATED APPLICATIONS

Not Applicable

STATEMENT REGARDING FEDERALLY SPONSORED RESEARCH

Not Applicable

BACKGROUND OF THE INVENTION

The invention relates to a radial piston pump of the type, in which an eccentric rotor is adapted to cause the pistons to reciprocatively move within radially extending cylinders.

Known radial piston pumps, such as disclosed in U.S. Pat. Nos. 5,509,347; 5,542,823; and 5,647,729 includes a piston ring surrounded by a casing. A plurality of radially extending cylinders are formed in the piston. Each cylinder receives a piston that is reciprocatively moved in the cylinder by an eccentric rotor. Fluid, such as hydraulic fluid, is drawn into each cylinder through an intake passageway in fluid communication with a fluid reservoir. The fluid is expelled from the cylinder through a radially outer end of the cylinder past a pressure valve into a circumferential passageway formed between the piston ring radial outer surface and an annular member sandwiched between the piston ring and the casing. Compressed fluid in the circumferential passageway flows through a radially directed passageway formed in the piston ring to an axially extending connection for a pressure line The above described radial piston pump performs adequately. However, servicing the pump requires removing the casing to gain access to the piston ring. If one of the pressure valves requires servicing, the annular member must also be removed. Moreover, if a higher capacity pump is required, a different piston ring having additional cylinders or larger cylinders must be provided which limits the range of pump capacities a pump supplier can provide.

SUMMARY OF THE INVENTION

The present invention provides a piston pump including an inlet manifold, and outlet manifold, and a piston ring sandwiched between the inlet and outlet manifolds. The inlet manifold has a first face and a second face with at least one outlet formed in the second face. The outlet manifold has a first face and a second face, and includes at least one inlet formed in the outlet manifold first face. The piston ring has an inlet face and an exhaust face, wherein the piston ring is sandwiched between said inlet manifold second face and said outlet manifold first face, and has at least one radially extending cylinder formed therein. The piston ring further includes an inlet passageway formed in the piston ring between the inlet face and the cylinder and in fluid communication with the inlet manifold. The piston ring also has an exhaust passageway formed therein between said cylinder and the exhaust face and in fluid communication with the outlet manifold inlet. A piston is disposed in the cylinder for reciprocating movement, wherein reciprocating movement of the piston allows fluid into the cylinder through the inlet passageway and exhausts fluid out of the cylinder through the exhaust passageway.

A general objective of the present invention is to provide a radial piston pump that is easy to assemble and maintain. This objective is accomplished by providing a stacked radial piston pump having a self contained piston ring sandwiched between an intake manifold and an exhaust manifold.

Another objective of the present invention is to provide a radial piston pump that can be easily modified to produce a desired output fluid flow. This objective is accomplished by stacking piston rings in series to produce a desired output fluid flow.

The foregoing and other objects and advantages of the invention will appear from the following description. In the description, reference is made to the accompanying drawings which form a part hereof, and in which there is shown by way of illustration a preferred embodiment of the invention.

BRIEF DESCRIPTION OF THE DRAWINGS

FIG. 5 is a top view of the piston ring of FIG. 1;

FIG. 6 is a cross sectional view along line 6—6 of FIG. 5;

FIG. 7 is a sectional view along line 7—7 of FIG. 6;

DETAILED DESCRIPTION OF THE INVENTION

Figure 1:
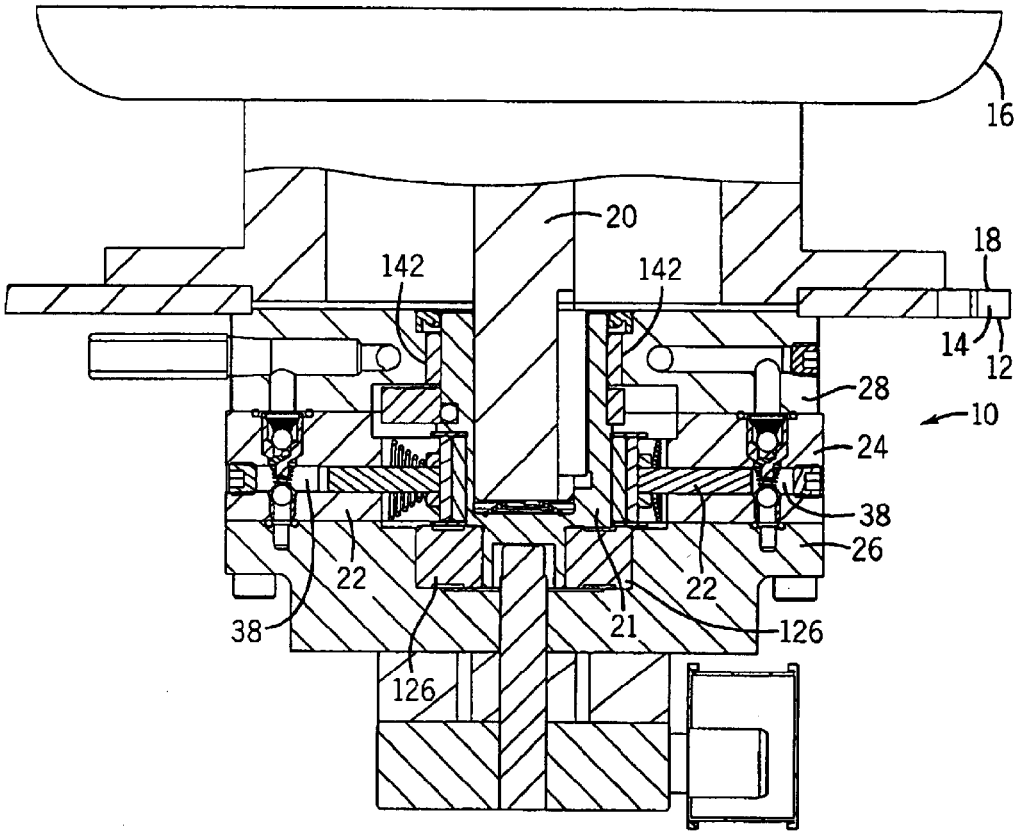
FIG. 1 is a cut away side view of a radial piston pump incorporating the present invention.

A radial piston pump 10, shown in FIGS. 1–11, includes a piston ring 24 sandwiched between an intake manifold 26 and an exhaust manifold 28, and is submerged in a fluid, such as oil, hydraulic fluid, and the like. The pump 10 is fixed to one side 12 of a cover plate 14, and is driven by an electric motor 16 fixed to an opposing side 18 of the plate 14. The plate 14 covers an opening formed in a reservoir containing the fluid.

The electric motor 16 has a rotatable shaft 20 that extends through the plate 14 to rotatably drive pistons 22 reciprocatively received in cylinders 38 formed in the piston ring 24. The motor 16 can be any device having a rotating shaft, such as an electric motor, combustion engine, air powered, and the like. In the embodiment shown in FIGS. 1–11, the motor shaft 20 is concentric with the center of the piston ring 24, and rotatably drives an eccentric rotor 21. A counterbalance 39 fixed to the eccentric rotor 21, such as by a press fit, minimizes vibrations caused by the eccentricity of the rotor 21. Bearings 126, 142 rotatably support the shaft 20 extending through the manifolds 26, 28 and piston ring 24. Seals 43 surrounding the rotor 21 prevent fluid from leaking into the motor 16.

The piston ring 24 is a self contained pump unit driven by the electric motor 16. Low pressure fluid is fed to the piston ring 24 by the intake manifold 26, and high pressure fluid is channeled away from the piston ring 24 by the exhaust manifold 28. The piston ring 24 and manifolds 26, 28 are stacked together to simplify serviceability, and provides other advantages, as described below.

As shown in FIGS. 2 and 4–7, the piston ring 24 is an annular ring having an intake face 30 and an exhaust face 32 which join an inner diameter radially inwardly facing surface 34 and an outer diameter radially outwardly facing surface 36. The intake face 30 abuts the intake manifold 26, and the exhaust face 32 abuts the exhaust manifold 28. Preferably, the piston ring 24 is formed from metal, such as steel, iron, aluminum, and the like, and the faces 30, 32 are machined substantially flat.

Six radially extending equidistantly spaced cylinders 38 are formed through the piston ring 24, and extend between the radially inwardly and outwardly facing surfaces 34, 36. Preferably, each cylinder 38 is formed by drilling a hole radially inwardly through the piston ring 24. A plug 40 threadably engaging the radially outer end 42 of each cylinder 38 closes the radially outer end 42 of the respective cylinder 38. Although six cylinders 38 are disclosed that are equidistantly radially spaced in the piston ring, one or more cylinders can be provided without departing from the scope of the invention. Preferably, three or more cylinders are provided that are equidistantly radially spaced to provide a balanced pump which operates without undue vibration.

A cylindrical piston 22 slidably extends radially into the radially inner end of each cylinder 38, and has a radially inner end 23 and a radially outer end 25. The inner end 23 includes a head 27 that engages the eccentric rotor. A spring 29 interposed between the head 27 and piston ring radially inwardly facing surface 34 biases the piston 22 radially inwardly.

Each piston 22 is reciprocatively driven by the eccentric rotor 21 which urges the pistons 22 radially outwardly against the urging of the spring 29 to compress the fluid in the cylinder 38. The rotor 21 is rotatably driven by the motor 16, and is supported in the center of the piston ring 24 by the bearings 126, 142 mounted in cavities 124, 140 formed in the intake and exhaust manifolds 26, 28. Fluid leaking past the pistons 22 lubricates the rotor 21 and bearings 126, 142. Advantageously, the fluid leaking past the pistons 22 also cools the pistons 22, rotor 21, and bearings 126, 142, and returns to the reservoir through the vent 35.

A free floating cam ring 31 is disposed in the center of the annular piston ring 24, and, as the rotor 21 rotates, is urged into sequential engagement with the pistons 22 by the eccentric rotor 21. The cam ring 31 sequentially urges the pistons 22 radially outwardly into cylinders 38 formed in the piston ring 24 to compress the fluid in the cylinders 38. Preferably, the cam ring 31 is polygonal, and has at least a number of flat surface equal to the number of pistons. However, a piston ring without flat surfaces, such as a round ring, can be provided without departing from the scope of the invention.

The pistons 22 pump the fluid from intake passageways 44 that direct low pressure fluid into the cylinders 38 to exhaust passageways 46 that channel high pressure fluid out of each cylinder 38. The passageways 44, 46 for each cylinder 38 are substantially identical, and thus will be described with respect to one of the cylinders 38 with the understanding that the other intake and exhaust passageways 44, 46 are substantially identical.

Referring to FIGS. 4–7, each intake passageway 44 formed in the piston ring 24 extends from the intake face 30 to the cylinder 38, and is in fluid communication with the fluid in the reservoir. Fluid flows into the cylinder 38 flows past an intake check valve 48 disposed in the intake passageway 44. The intake check valve 48 includes a valve seat 50 pressed into the intake passageway 44. A ball 52 is urged against the valve seat 50 by a spring 54, and prevents the flow of fluid having a pressure less than a predetermined release pressure into the cylinder 38 past the ball 52. The spring 54 is aligned with the ball 52 by a frustoconical ball stop 56 extending through the cylinder 38 from the exhaust passageway 46. The ball stop 56 is retained in place by a valve seat 58 pressed into the exhaust passageway 48.

The release pressure of the intake check valve 48 is equal to the force exerted on the ball 52 by the spring 54 and fluid in the cylinder 38. Advantageously, the intake check valve 48 allows fluid having a pressure greater than the release pressure into the cylinder 38 and prevents fluid from flowing from the cylinder 38 back into the reservoir through the intake passageway 44.

Each exhaust passageway 46 formed in the piston ring 24 extends from the cylinder 38 to the exhaust face 32, and provides a path for compressed fluid out of the cylinder 38. Fluid flowing out of the cylinder 38 through the exhaust passageway 46 flows past an exhaust check valve 60 disposed in the exhaust passageway 46. The exhaust check valve 60 includes the valve seat 58 pressed into the exhaust passageway 46. A ball 62 is urged against the valve seat 58 by a spring 64, and prevents the flow of fluid having a pressure less than a predetermined release pressure into the exhaust passageway 46 past the ball 62. The spring 64 is retained in place by a retaining ring 67 received in a groove 68 formed in the valve seat 58.

The release pressure for the exhaust check valve 60 is equal to the force exerted on the ball 62 by the spring 64 and fluid in the cylinder 38. Advantageously, the exhaust check valve 60 allows fluid having a pressure greater than the exhaust check valve relief pressure in the cylinder 38 to escape into the exhaust passageway 46 and prevents the fluid in the exhaust passageway 46 from flowing back into the cylinder 38. Preferably, the release pressure of the exhaust check valve 60 is greater than the release pressure of the intake check valve 48 to ensure that fluid under a low pressure flows into the cylinder 38 from the intake passageway 44 and fluid having a higher pressure exits the cylinder 38 through the exhaust passageway 46.

Preferably, the intake and exhaust passageways 44, 46 for each cylinder 38 are formed by drilling an axial countersunk hole through the piston ring 24 that intersects with the cylinder 38 proximal the radially outer end 42 of the cylinder 38. The intake and exhaust check valves 48, 60 are aligned in the hole on opposing sides of the cylinder 38 which simplifies fabrication and assembly. Moreover, access to the check valves 48, 60 for servicing is improved over the prior art by providing inline check valves 48, 60 as disclosed herein.

A bypass valve 66, shown in FIGS. 4–6 and 8, forming part of the piston ring 24 vents low pressure fluid back into the reservoir when the fluid in the exhaust passageway 46 is above a predetermined pressure. The bypass valve 66 is received in a bore 68 formed in the radially outwardly facing surface 36 of the piston ring 24, and includes a plunger 70 biased radially inwardly by a helical spring 72. The spring 72 and a tail end 74 of the plunger 70 is received in a cap 76 threadably engaging the bore 68. The cap 76 compresses the spring 72 to urge the plunger 70 radially inwardly.

The bore 68 includes an outer section 78, middle section 80, and inner section 82, each section 78, 80, 82 having a different diameter. The outer section 78 opens to the radially outwardly facing surface 36 of the piston ring 24, and threadably engages the cap 76. The middle section 80 is coaxial with the outer section 78, and has a smaller diameter than the outer section 78. The inner section 82 is coaxial with the middle section 80, and has a slightly smaller diameter than the middle section 80 to form a valve seat for the plunger 70.

The bore 68 is in fluid communication with the exhaust passageway 46 of each cylinder 38 via a pilot passageway 84 to actuate the bypass valve 66 when the pressure in the exhaust passageways 46 exceeds the predetermined pressure. The pilot passageway 84 is formed through the exhaust manifold 28 and piston ring 24 and intersects exhaust connecting passageways 144 formed in the exhaust manifold 28 to fluidly connect the pilot passageway 84 to the exhaust passageways 46. The portion of the pilot passageway 84 formed in the piston ring 24 intersects the inner section 82 of the bore 68 at a radially inward end 86 of the inner section 82. A recess 88 formed in the exhaust face 32 of the piston ring 24 surrounding the pilot passageway 84 receives an O-ring 90 to seal the pilot passageway 84 at the interface between the piston ring 24 and exhaust manifold 28.

A bypass passageway 92, 94 formed in the piston ring 24 intersects the middle section 80 of the bore 68, and is in fluid communication with the intake passageways 44 of each cylinder 38 upstream of each intake check valve 48. A first portion 92 of the bypass passageway 92, 94 provides a path for low pressure fluid upstream of the intake check valves 48 past the cylinders 38 into the bore 68 when the pressure in the exhaust passageways 46 exceed the predetermined pressure.

The bypassed fluid is exhausted back into the reservoir through a second portion 94 of the bypass passageway 92, 94 in fluid communication with the bore 68. The second portion of the bypass passageway 92, 94 is formed in the exhaust manifold 28 and piston ring 24, and intersects the outer section 78 of the bore 68. A recess 96 formed in the exhaust 32 face of the piston ring 24 surrounding the second portion 94 of the bypass passageway 92, 94 receives an O-ring 98 to seal the interface between the piston ring 24 and exhaust manifold 28. A coupling 147 fixed in the bypass passageway second portion 94 can be provided for connecting to a hose to direct the bypassed fluid into the reservoir.

The plunger 70 has a head end 100 and the tail end 74 separated by a radially inwardly pointing conical section 104, and is urged radially inwardly toward the inner section 82 of the bore 68 by the spring 72. The tail end 74 extends through the outer section 78 of the bore 68 and center of the spring 72 into the cap 76. The spring 72 exerts a force on the conical section 104, and urges the nose 106 of conical section 104 into the middle section 80 to seal the middle section 80 from the outer section 78. The head end 100 extends through the middle section 80 of the bore 68 into the inner section 82. A radial groove 108 formed in the head end 100 receives an O-ring 108 and a back-up washer 110. The O-ring 108 sealingly engages the inner section 82 to prevent high pressure fluid from flowing past the plunger 70 from the inner section 82 to the other sections 78, 80.

High pressure fluid in the pilot passageway 84 exerts a force on the head end 100, and urges the plunger 70 radially outwardly against the force of the spring 72. When the pressure of the fluid in the pilot passageway 84 exceeds the force exerted on the plunger 70 by the spring 72, the plunger 70 moves radially outwardly against the force of the spring 72, and unseats the conical section 104 of the plunger 70 from the middle section 82. When the conical section 104 is unseated, low pressure bypass fluid from the bypass passageway portion 92 flows into the middle section 80 past the conical section 104 into the outer section 78, and through the bypass passageway portion 94 which exhausts the bypassed fluid back into the reservoir. The spring 72 has a spring constant that is dependent upon the particular fluid pressure desired that is required in the pilot passageway 84 to unseat the conical section 104 from the middle section 80 and allow fluid to flow from the bypass passageway portion 92 through the bore 68 into the bypass passageway portion 94.

Referring to FIGS. 4, 9–11, the intake manifold 26 abuts the intake face 30 of the piston ring 24, and has an intake side 112 and an exhaust side 114. A flange 116 extending radially from the circumferential edge 118 of the intake manifold 26 includes a plurality of radially equidistantly spaced axial holes 120. Each hole 120 receives a bolt 122 that extends through the piston ring 24 and threadably engages the exhaust manifold 28 to sandwich the piston ring 24 between the manifolds 26, 28. A central cavity 124 formed in the exhaust side 144 of the intake manifold 26 receives bearings 126 to rotatably mount the rotor 128 rotatably driven by the motor 16, and intersects a central opening 129 coaxial with the rotor 21.

A feed passageway 130 extends through the intake manifold 26 from the intake side 112 to the exhaust side 114, and intersects a circular distribution channel 132 formed in the face of the exhaust side 114 of the intake manifold 26. The distribution channel 132 distributes the fluid to the intake passageways 44 formed in the piston ring 24 for each cylinder 38, and is in fluid communication with the bypass passageway portion 92 of the bypass valve 66. O-rings 134, 136 interposed between the intake manifold 26 and piston ring 24 prevent fluid from escaping the distribution channel 132 between the intake manifold 26 and piston ring 24. Although an O-ring is preferred for sealing, any sealing method, such as providing a gasket, machining the surfaces to a tight tolerance, and the like, can be used to prevent leakage. Advantageously, forming the distribution channel 132 in the face of the intake manifold exhaust side 112 simplifies manufacturing and assembly.

Figure 2:
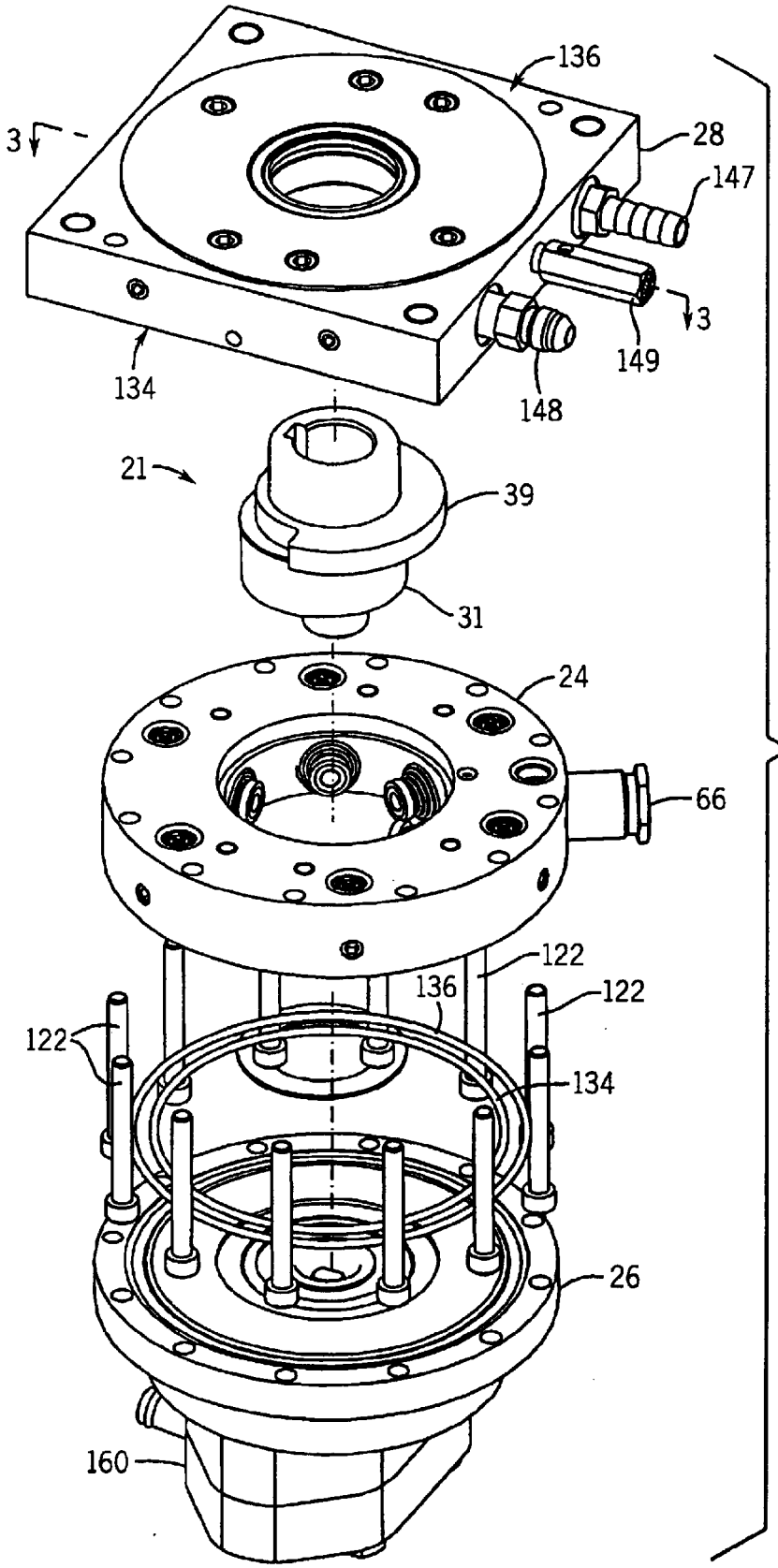
FIG. 2 is an exploded, perspective view of the pump of FIG. 1.
Figure 3:
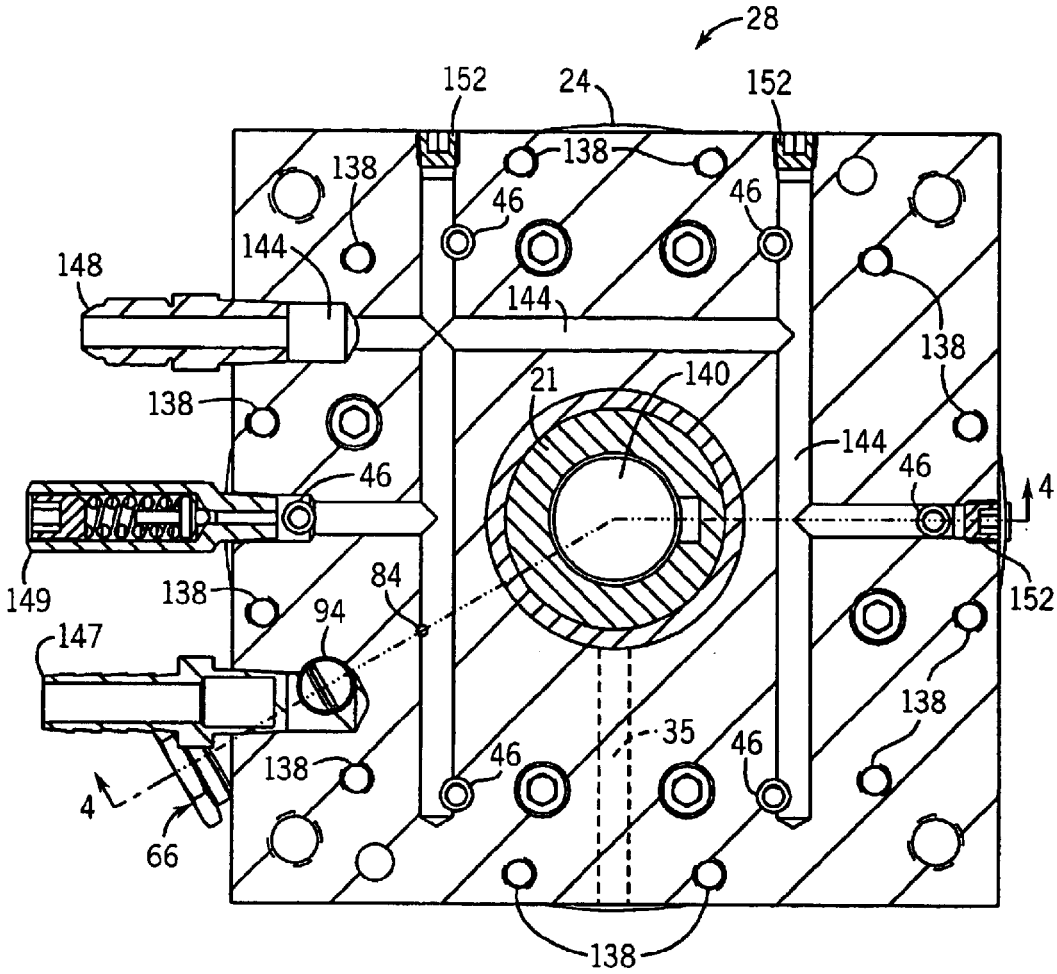
FIG. 3 is a cross sectional view along line 3—3 of FIG. 2.
Figure 4:
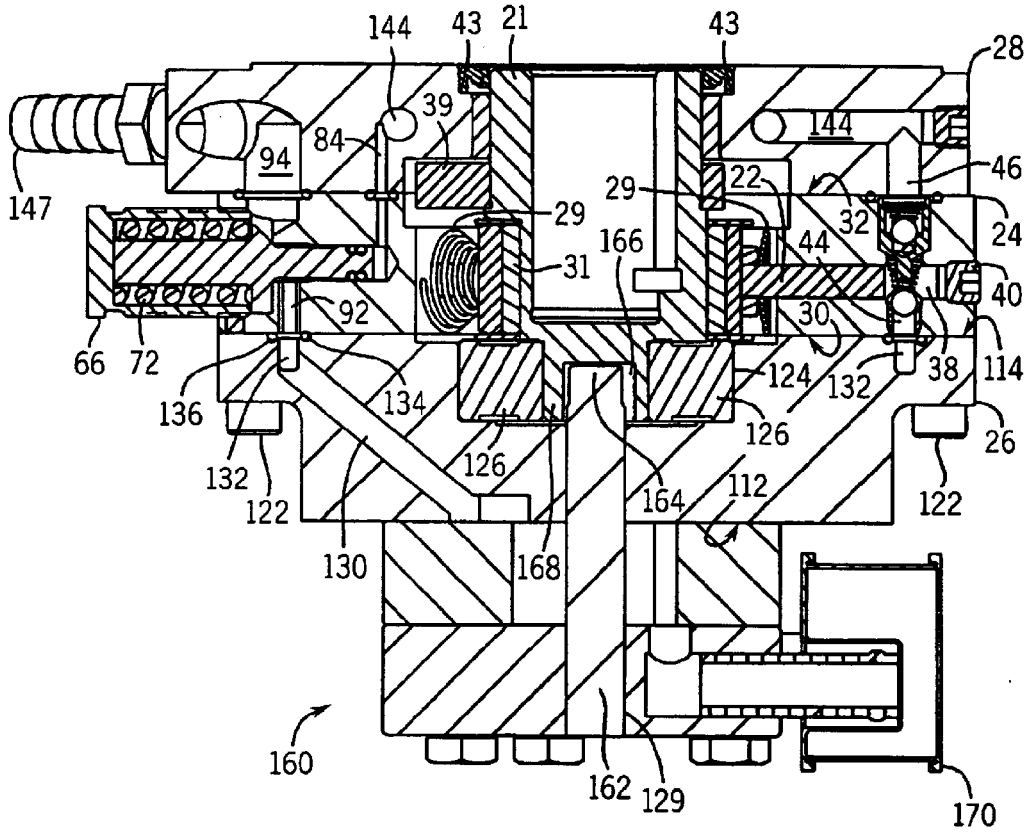
FIG. 4 is a cross sectional view along line 4—4 of FIG. 3.
Figure 8:
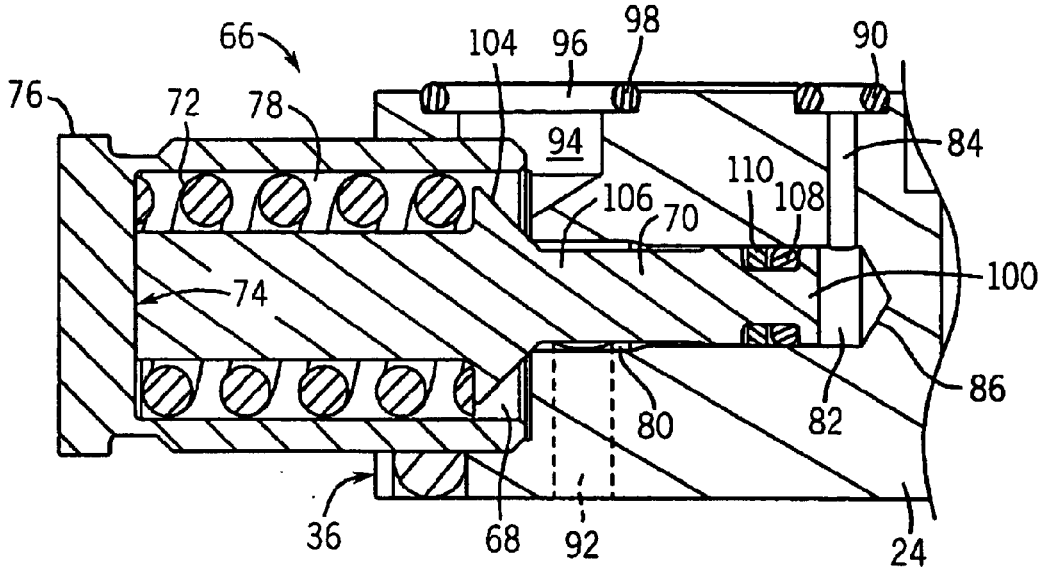
FIG. 8 is a cross sectional view along line 8—8 of FIG. 5.
Figure 9:
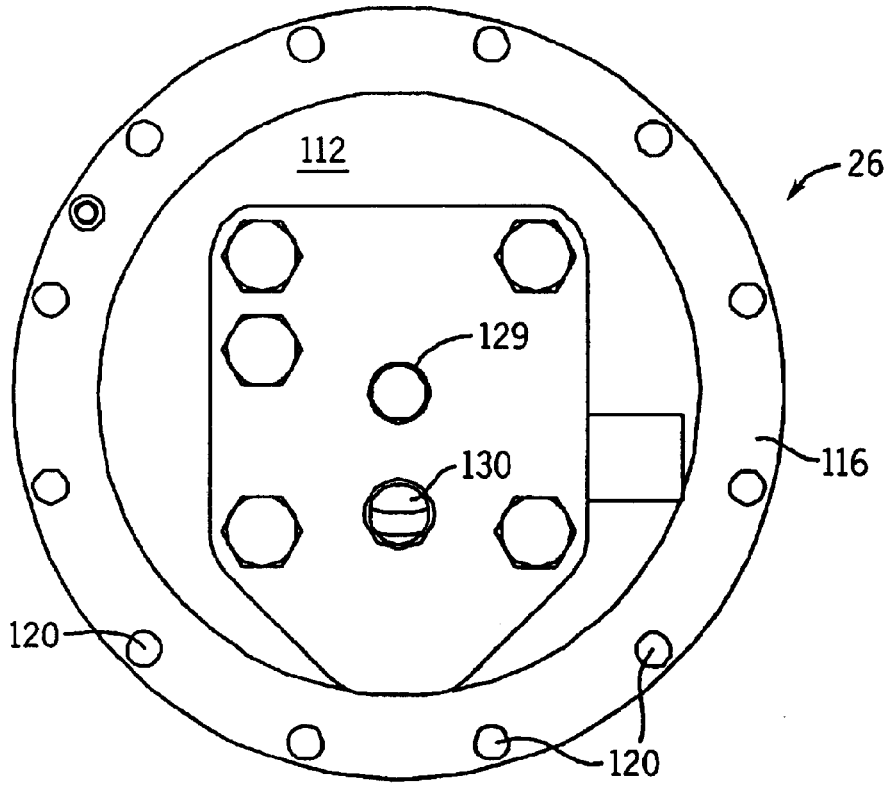
FIG. 9 is a bottom view of an intake manifold of FIG. 1.
Figure 10:
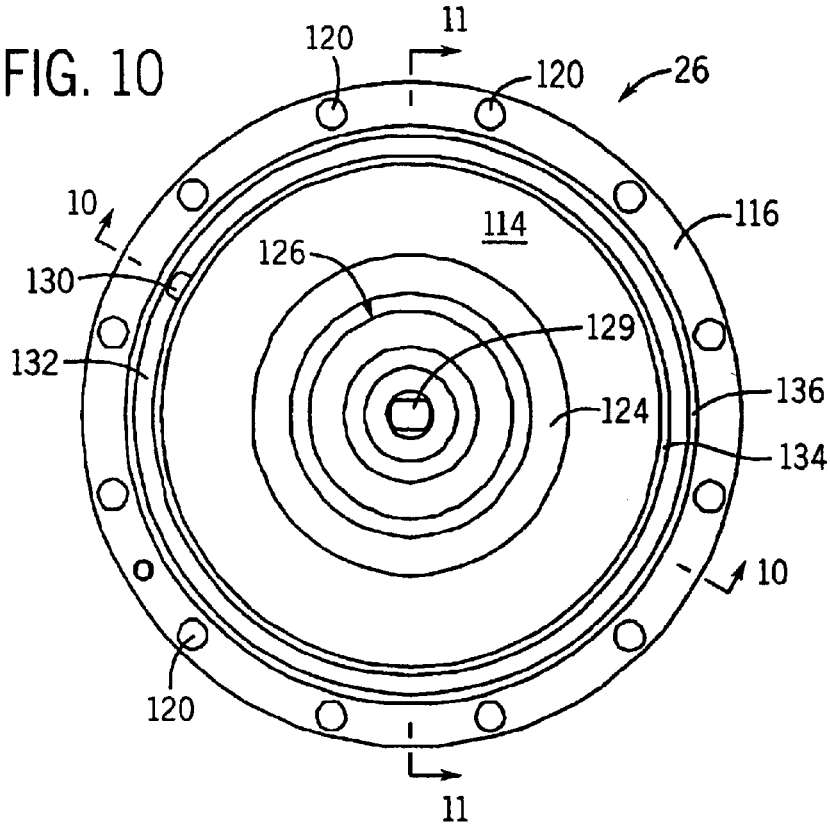
FIG. 10 is a top view of the intake manifold of FIG. 9.
Figure 11:
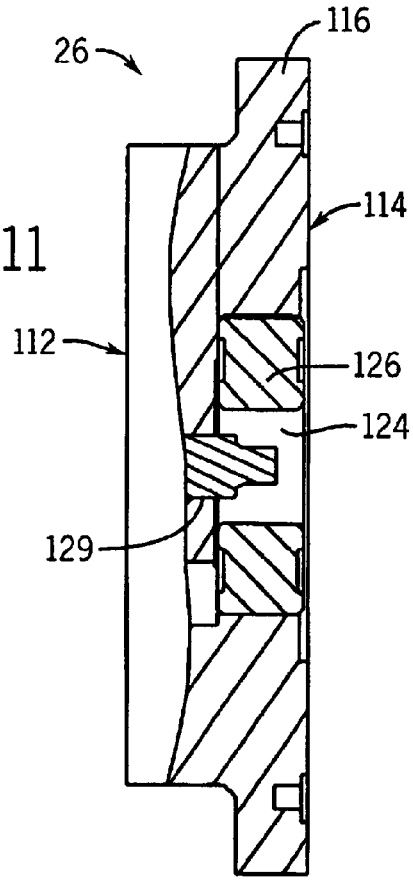
FIG. 11 is a cross sectional view along line 11—11 of FIG. 10.

The exhaust manifold 28, shown in FIGS. 2–4, abuts the exhaust face 32 of the piston ring 24, and has an intake side 134 and an exhaust side 136. A plurality of axially extending threaded holes 138 is formed in the intake side 134 that abuts the exhaust face 32 of the piston ring 24. Each hole 138 threadably engages one of the bolts 122 that extend through the piston ring 24 to sandwich the piston ring 24 between the manifolds 26, 28. A central cavity 140 formed in the intake side 134 of the exhaust manifold 28 receives bearings 142 to rotatably mount the rotor 128.

A radially extending vent 35 formed between the radially inwardly and outwardly intake and exhaust sides 134, 136 vents fluid in the central cavity 140 into the reservoir. Although forming the vent 35 in the exhaust manifold is preferred, the vent 35 can be formed in the piston ring and/or intake manifold without departing from the scope of the invention.

Exhaust connecting passageways 144 bored in the exhaust manifold 28 connect the portions of the exhaust passageways 46 formed in the exhaust manifold 28 in fluid communication with each cylinder 38 and the pilot passageway 84 of the bypass valve 66. One open end of one of the exhaust connecting passageways 144 threadably engages a fitting 148 for connecting to a hose. A relief valve 149 fixed in another open end of the exhaust connecting passageways 144 relieves pressure in the exhaust connecting passageways 144 if the pressure therein exceeds a predetermined level. The other open ends of the exhaust connecting passageways 144 are closed with plugs 152 threadably engaging each of the other open ends.

Referring to FIGS. 1, 2, and 4, preferably, the rotor 21 also rotatably drives a primary low pressure gear pump 160 mounted to the intake side 112 of the intake manifold 26. A shaft 162 extending through the central opening 129 formed in the intake manifold 26 includes a tang 164 that engages a slot 166 formed on the rotor end 168 to rotatably drive the gear pump shaft 162 and simplify assembly. The gear pump 160 pumps fluid from the reservoir through an intake filter 170 into the feed passageway 130 (shown in FIG. 10) formed in the piston ring 24.

In use, with reference to FIGS. 1–11, the rotor 21 rotatably drives the gear pump 160 which feeds fluid through the feed passageway 130 formed in the intake manifold 26 into the distribution channel 132 which distributes the fluid to the intake passageway 44 of each cylinder 38. When the fluid in the intake passageway 44 has sufficient pressure to pass through the intake check valve 48, it fills the cylinder 38 urging the piston 22 radially inwardly. Upon rotation of the eccentric rotor 21, and engagement of the cam ring 31 with the piston 22, the piston 22 is urged radially outwardly into the cylinder 38 in a compression stroke to compress fluid disposed in the cylinder 38. A portion of the compressed fluid having a pressure greater than the release pressure of the exhaust check valve 60 escapes past the exhaust check valve 60 into the exhaust passageway 46. Upon completion of the piston pressure stroke, the low pressure fluid entering the cylinder 38 through the intake passageway 44 once again urges the piston 22 radially inwardly toward the center of the piston ring 24. Advantageously, if the fluid path downstream of the exhaust check valve 60 is blocked causing the pressure in the exhaust passageway 46 to rise above a predetermined level, the high pressure fluid in the exhaust passageway 46 opens the bypass valve 66 to bypass the fluid in the intake passageway 44 back into the reservoir.

Figure 12:
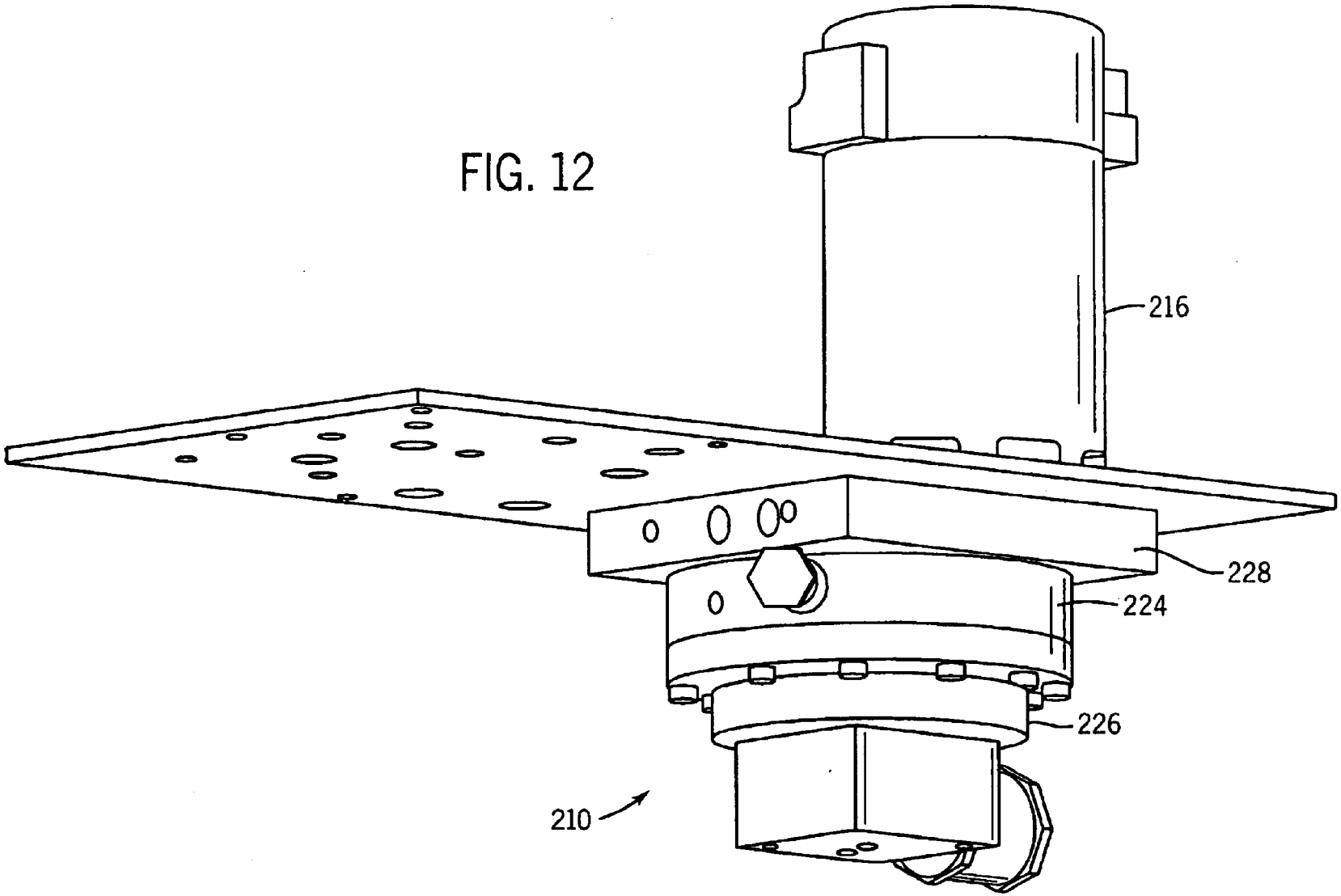
FIG. 12 is a perspective view of another radial piston pump incorporating the present invention.
Figure 13:
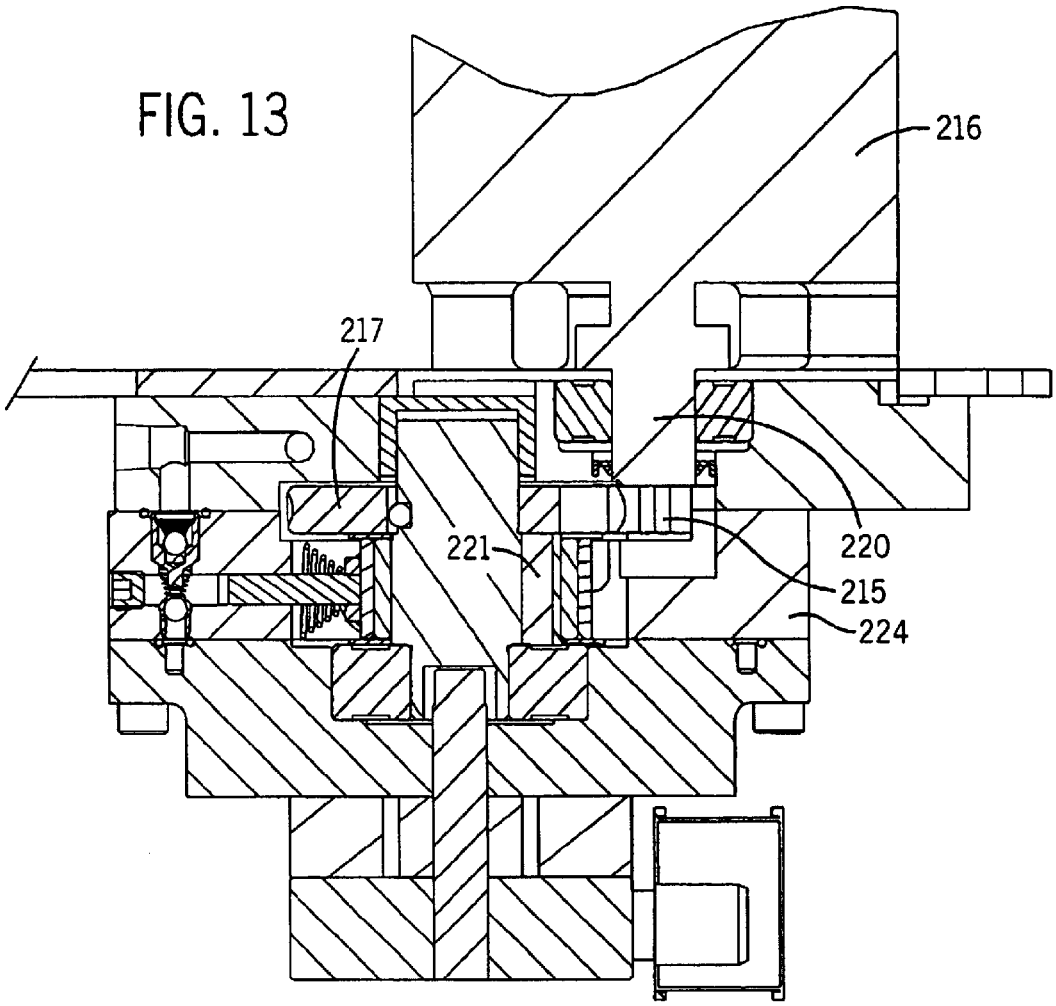
FIG. 13 is a cut away side view of the pump of FIG. 12.
Figure 14:
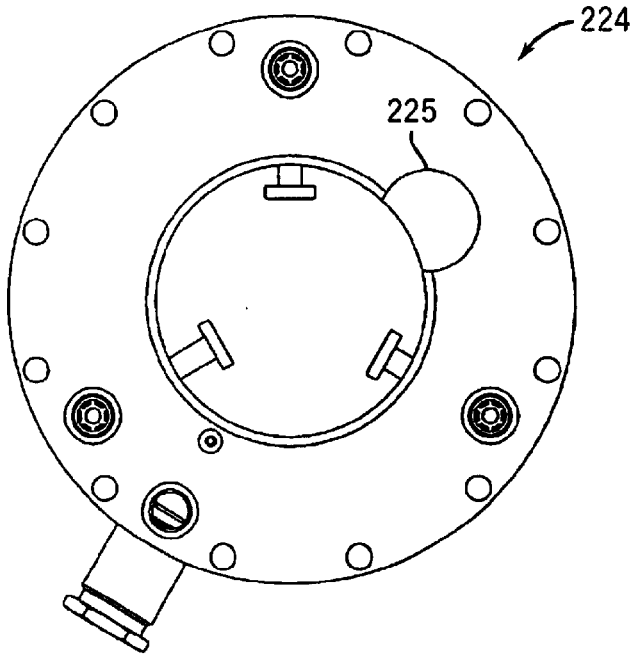
FIG. 14 is a top view of a piston ring of FIG. 12.

In another embodiment shown in FIGS. 12–14, a radial piston pump 210 includes a piston ring 224 sandwiched between an intake manifold 226 and an exhaust manifold 228, such as disclosed above, wherein an eccentric rotor 221 is rotatably driven by a motor shaft 220 extending from a motor 216. The motor shaft 220 driving the eccentric rotor 221 in the embodiment disclosed in FIGS. 12–14, however, is offset from the rotor axis. The motor shaft 220 includes a pinion 215 rotatably driving a helical gear 217 that forms part of the rotor. Preferably, the helical gear 217 is unbalanced, such as by removing material from the gear 217 by drilling, to offset the unbalanced eccentric rotor 221 and minimize vibrations. As shown in FIG. 14, the piston ring 224 includes a cutout 225 to accommodate the offset motor shaft 220.

Figure 15:
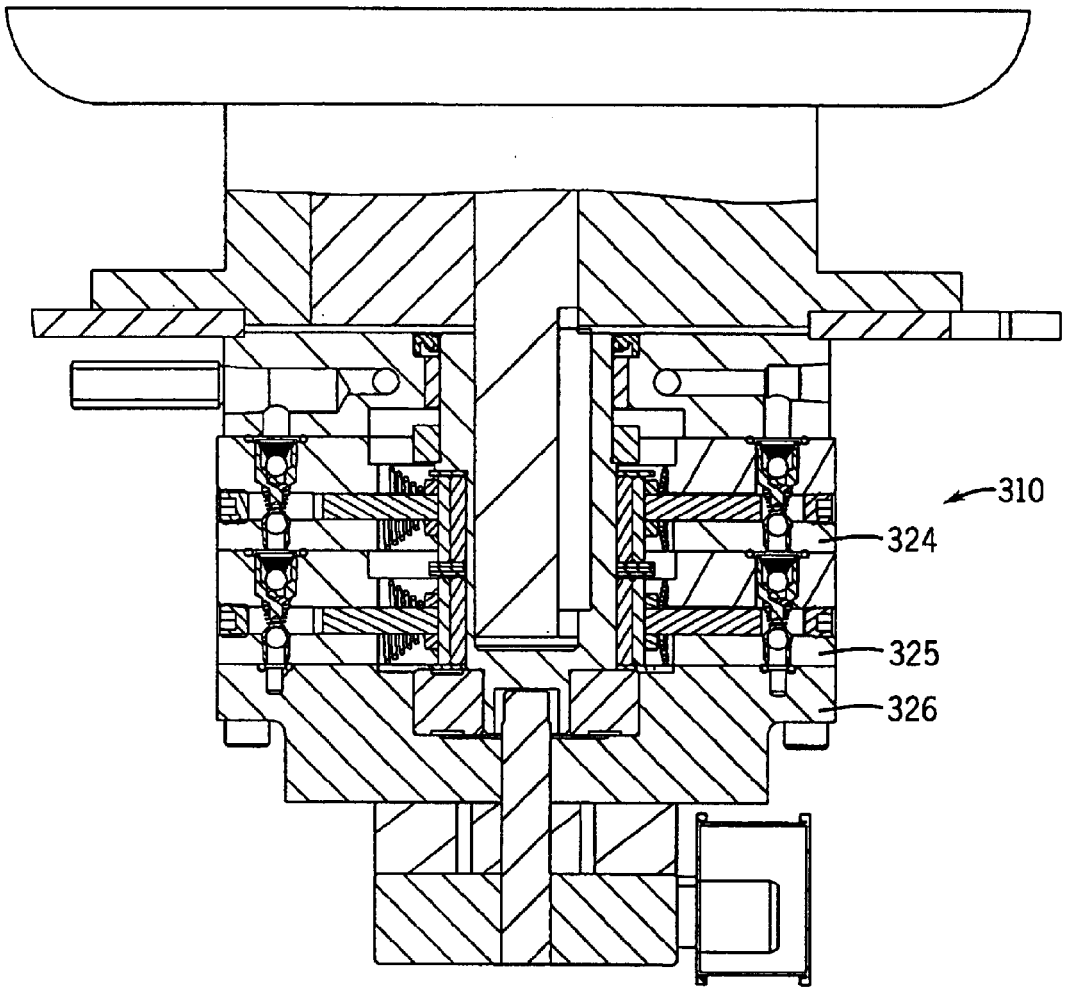
FIG. 15 is a is a cut away side view of another radial piston pump incorporating the present invention having more than one piston ring.

In another embodiment shown in FIG. 15, a radial piston pump 310 includes a second piston ring 325 sandwiched between the first piston ring 324 and the intake manifold 326. The second piston ring 325 pumps fluid into the first piston ring 324 which further increases the fluid pressure of the fluid prior to exiting the pump 310 through a exhaust manifold 328. Advantageously, any number of piston rings can be provided to produce the desired output pressure of the fluid exiting the exhaust manifold.

Preferably, exhaust passageways formed in the second piston ring are offset from the intake passageways of the first, or downstream, piston ring to avoid pumping fluid directly into the intake check valve of the first piston ring. Exhaust passageways formed in the second piston ring can be offset from the intake passageways of the first piston ring by rotating the second piston ring relative to the first piston ring and forming channels in the exhaust face of the second piston ring which are in fluid communication with the exhaust passageways of the second piston ring and the intake passageways of the first piston ring.

Figure 16:
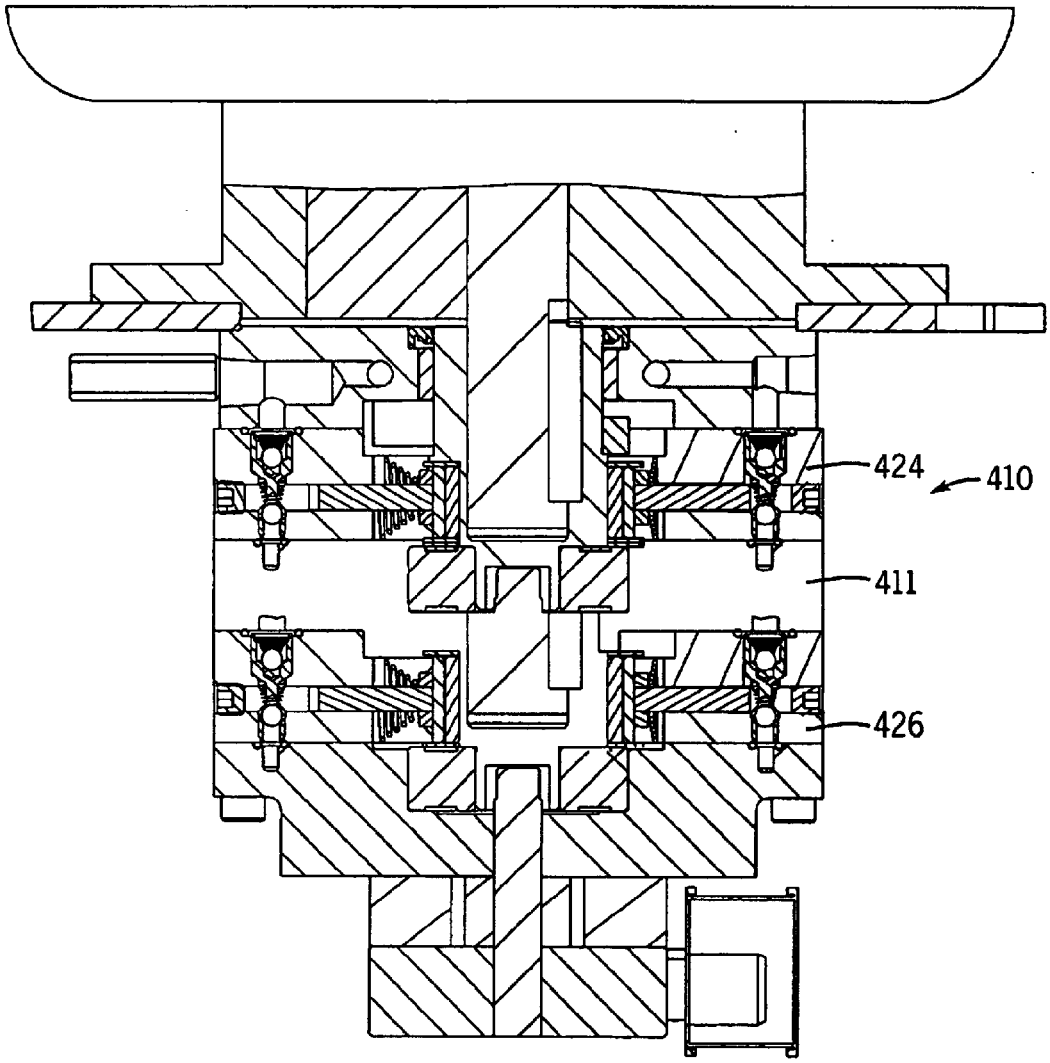
FIG. 16 is a cut away side view of yet another radial piston pump incorporating the present invention having more than one piston ring.

In another alternative shown in FIG. 16, a radial piston pump 410 includes an intermediate manifold 411 sandwiched between the first and second piston rings 424, 425. The intermediate manifold 411 has connecting passageways in fluid communication with the exhaust passageways of the second piston ring and the intake passageways of the first piston ring. The connecting passageways can fluidly connect offset cylinders or include baffles that prevent pumping fluid directly into the intake check valve of the first piston ring While there has been shown and described what are at present considered the preferred embodiment of the invention, it will be obvious to those skilled in the art that various changes and modifications can be made therein without departing from the scope of the invention defined by the appended claims. Therefore, various alternatives and embodiments are contemplated as being within the scope of the following claims particularly pointing out and distinctly claiming the subject matter regarded as the invention.

What is claimed is:

1. A piston pump comprising:

an inlet manifold having a first face and a second face, and at least one outlet formed in said second face;

an exhaust manifold having a first face and a second face, and at least one inlet formed in said outlet manifold first face;

a first piston ring having an inlet face and an exhaust face, said piston ring sandwiched between said inlet manifold second face and said exhaust manifold first face, and having at least one radially extending cylinder formed therein, said piston ring having an inlet passageway formed in said piston ring between said inlet face and said cylinder and in fluid communication with said inlet manifold outlet, and said piston ring having an exhaust passageway formed in said piston ring between said cylinder and said exhaust face and in fluid communication with said outlet manifold inlet;

a check valve disposed in said inlet passageway;

a check valve disposed in said exhaust passageway; and a piston disposed in said cylinder for reciprocating movement, wherein reciprocating movement of said piston allows fluid into said cylinder from said inlet face through said inlet passageway and exhausts fluid out of said cylinder through said exhaust passageway.

2. The piston pump as in claim 1, in which said inlet manifold includes a gear pump which draws fluid into said inlet manifold inlet and exhausts fluid out of said inlet manifold outlet.

3. The piston pump as in claim 1, in which said inlet passageway and said exhaust passageway are collinear.

4. The piston pump as in claim 1, in which a second piston ring is interposed between said first piston ring and one of said inlet manifold and said exhaust manifold.

5. The piston pump as in claim 4, in which a connecting manifold is interposed between said first and second piston rings.

6. The piston pump as in claim 1, in which a passageway formed in said inlet manifold second face fluidly connects said inlet manifold outlet and said piston ring inlet passageway.

7. The piston pump as in claim 1, including a bypass valve forming part of said piston ring in fluid communication with said exhaust passageway.

8. The piston pump as in claim 7, in which said intake passageway and a bypass passageway are in fluid communication with said bypass valve when fluid in said exhaust passageway reaches a predetermined pressure.

9. The piston pump as in claim 1, in which a plurality of cylinders are formed in said piston ring, and a piston is disposed in each of said cylinders.

10. The piston pump as in claim 9, in which an inlet passageway extends from each of said cylinders and said inlet face, and a distribution channel formed in said inlet manifold second face is in fluid communication with each of said inlet passageways and said at least one outlet.

11. The piston pump as in claim 1, in which an eccentric rotor urges said piston radially outwardly to compress fluid disposed in said cylinder.

12. The piston pump as in claim 11, in which said rotor is rotatably driven by a coaxial shaft.

13. The piston pump as in claim 11, in which said rotor is rotatably driven by a shaft having a axis of rotation offset from an axis of rotation of said rotor.

14. The piston pump as in claim 11, in which a cam ring surrounding said rotor is urged into engagement with said piston by said rotor.

15. The piston pump as in claim 1, in which a vent formed radially through at least one of said exhaust manifold, piston ring, and inlet manifold, vents fluid leaking past said piston in said cylinder.

16. A radial piston pump having a piston ring, said piston ring comprising:

at least one radially extending cylinder;

a piston reciprocatively received in said cylinder for compressing a fluid an inlet passageway directing a fluid into said cylinder;

an outlet passageway directing fluid compressed by said piston out of said cylinder; and and a bypass valve in fluid communication with said inlet and outlet passageways for venting fluid from said inlet passageway when pressure in said outlet passageway exceeds a predetermined level.

17. The radial piston pump as in claim 16, in which said piston ring has an inlet face and an exhaust face, and said radial piston pump includes an inlet manifold having a first face and a second face with at least one outlet formed in said second face and an exhaust manifold having a first face and a second face with at least one inlet formed in said outlet manifold first face, wherein said piston ring is sandwiched between said inlet manifold second face and said exhaust manifold first face, and said inlet passageway is in fluid communication with said inlet manifold outlet, and said exhaust passageway is in fluid communication with said outlet manifold inlet.

18. The piston pump as in claim 17, in which said inlet manifold includes a gear pump which draws fluid into said inlet manifold inlet and exhausts fluid out of said inlet manifold outlet.

19. The piston pump as in claim 17, in which said inlet passageway and said exhaust passageway are collinear.

20. The piston pump as in claim 17, in which a check valve is disposed in said inlet passageway.

21. The piston pump as in claim 17, in which a check valve is disposed in said exhaust passageway.

22. The piston pump as in claim 17, in which a second piston ring is interposed between said first piston ring and one of said inlet manifold and said exhaust manifold.

23. The piston pump as in claim 22, in which a connecting manifold is interposed between said first and second piston rings.

24. The piston pump as in claim 17, in which a passageway formed in said inlet manifold second face fluidly connects said inlet manifold outlet and said piston ring inlet passageway.

25. The piston pump as in claim 17, in which a plurality of cylinders are formed in said piston ring, and a piston is disposed in each of said cylinders.

26. The piston pump as in claim 25, in which an inlet passageway extends from each of said cylinders and said inlet face, and a distribution channel formed in said inlet manifold second face is in fluid communication with each of said inlet passageways and said at least one outlet.

27. The piston pump as in claim 17, in which an eccentric rotor urges said piston radially outwardly to compress fluid disposed in said cylinder.

28. The piston pump as in claim 27, in which said rotor is rotatably driven by a coaxial shaft.

29. The piston pump as in claim 28, in which said rotor is rotatably driven by a shaft having a axis of rotation offset from an axis of rotation of said rotor.

30. The piston pump as in claim 28, in which a cam ring surrounding said rotor is urged into engagement with said piston by said rotor.

31. The piston pump as in claim 17, in which a vent formed radially through at least one of said exhaust manifold, piston ring, and said inlet manifold, vents fluid leaking past said piston in said cylinder.

* * * * *